US007510510B2

(12) United States Patent
Chen et al.

(10) Patent No.: US 7,510,510 B2
(45) Date of Patent: Mar. 31, 2009

(54) HIP-ABDUCTION STEPPER EXERCISE APPARATUS

(75) Inventors: Chun-Ho Chen, Taiping (TW); Chia-Hsiun Chuang, Changhua (TW)

(73) Assignee: Cycling & Health Tech Industry R & D Center, Taichung (TW)

( * ) Notice: Subject to any disclaimer, the term of this patent is extended or adjusted under 35 U.S.C. 154(b) by 0 days.

(21) Appl. No.: 11/818,620

(22) Filed: Jun. 15, 2007

(65) Prior Publication Data

US 2008/0312044 A1 Dec. 18, 2008

(51) Int. Cl.
*A63B 22/04* (2006.01)

(52) U.S. Cl. ..... 482/52; 482/51; 482/71

(58) Field of Classification Search ..... 482/51, 482/52, 53, 57, 70, 71, 120, 907; 434/253, 434/255

See application file for complete search history.

(56) References Cited

U.S. PATENT DOCUMENTS 3,756,595 A * 9/1973 Hague ..... 482/51
5,391,130 A * 2/1995 Green et al. ..... 482/71
5,947,872 A * 9/1999 Ryan et al. ..... 482/51
5,957,816 A * 9/1999 Staffa ..... 482/70
6,165,107 A * 12/2000 Birrell ..... 482/70
7,223,209 B2 * 5/2007 Lee ..... 482/52
2001/0012811 A1 * 8/2001 Gordon ..... 482/70
2004/0058784 A1 * 3/2004 Roberts ..... 482/52
2004/0266587 A1 * 12/2004 Miller ..... 482/52
2004/0266588 A1 * 12/2004 Miller ..... 482/52
2005/0049117 A1 * 3/2005 Rodgers, Jr. ..... 482/52
2007/0167289 A1 * 7/2007 Alessandri et al. ..... 482/51
2008/0020902 A1 * 1/2008 Arnold ..... 482/51
2008/0132385 A1 * 6/2008 Alessandri et al. ..... 482/52
2008/0167164 A1 * 7/2008 Wang ..... 482/52

* cited by examiner

*Primary Examiner*—Loan H Thanh
*Assistant Examiner*—Daniel F Roland
(74) *Attorney, Agent, or Firm*—Charles E. Baxley

(57) ABSTRACT

A hip-abduction stepper exercise apparatus primarily comprises a base and two pedal assemblies settled abreast on the base. Each of the pedal assemblies includes a pedal, a vertical movement module, an expanding movement module, and a recovery module. The pedal is settled on the vertical movement module while the expanding movement module is settled on the base so that the two pedals can depart from or come close to each other with respect to a level position. The vertical movement module is connected to the expanding movement module so that the two pedals can vertically move in a direction non-perpendicular to the ground. The recovery module is connected to the vertical movement module and the base and provides an external force for returning the vertical movement module and the expanding movement module to initial positions thereof.

6 Claims, 9 Drawing Sheets

HIP-ABDUCTION STEPPER EXERCISE APPARATUS

BACKGROUND OF THE INVENTION

1. Technical Field

The present invention relates to stepper exercise apparatuses, and more particularly, to a stepper exercise apparatus providing a variety of exercise modes. The disclosed exercise apparatus has pedals guiding a primary backward and downward sliding track and an expanding track is additionally integrated into the primary sliding track. The variety of exercise modes of the stepper includes a simultaneous stepping mode, an alternate stepping mode, an undulate stepping mode, and a floating stepping mode.

2. Description of Related Art

When a user uses a conventional stepper exercise apparatus, he/she may primarily tread down a pedal assembly of the stepper exercise apparatus using his/her feet to prompt a right pedal and a left pedal of a pedal assembly to move vertically so that he/she can carry out leg movement resembling mark time in order to exercise his/her muscle groups that would be used during daily walking and stair climbing.

One notable problem of such conventional stepper exercise apparatus is the inflexible track of leg exercise it provides. Some additional exercise modes, such as simultaneous stepping and alternate stepping, or auxiliary function, such as guiding waist twisting may be available by properly modifying the mechanism of the conventional apparatus. However, the primary exercise track is still limited as the vertical movement with respect to the ground. Therefore, the muscle groups that get exercised are only those used during vertical stepping movement and, obviously, exercise for hip abductions is neglected in the conventional stepper exercise apparatus.

Some development has therefore been done to address the foregoing neglect. For example, a Taiwan Patent Application, appointed with Publication Number 577336, ameliorates the conventional vertical exercise movement into a non-vertical and expanding exercise movement. Thereby, in addition to the muscle groups that would be used during daily walking, the hip-abductions can also get exercised. However, in view of the mechanical design, as the said prior-art requires numerous components and complex structure, the fabrication and maintenance thereof are accordingly inconvenient. Besides, it bears a higher risk of inadequate transmission.

SUMMARY OF THE INVENTION

The present invention has been accomplished under these circumstances in view. It is one objective of the present invention to provide a hip-abduction stepper exercise apparatus that integrates an expanding exercise track into a traditional vertical exercise track of a stepper exercise apparatus so that in addition to the muscle groups that would be used during daily walking, the hip-abductions can also get proper exercise.

To achieve these and other objectives of the present invention, the hip-abduction stepper exercise apparatus primarily comprises a base and two unconnected pedal assemblies settled abreast on the base. Each said pedal assembly includes a pedal, a vertical movement module, an expanding movement module and a recovery module. The expanding movement module is settled on the base and can swing outward horizontally. The vertical movement module is connected to the expanding movement module and can move slantwise and downward toward the rear of the base from an initial altitude. The pedal is connected to the vertical movement module. The recovery module is connected to the vertical movement module and the base for providing an external force in order to return the vertical movement module to the initial altitude thereof and to return the expanding movement module to an initial position thereof.

The present invention discloses a stepper exercise apparatus providing a variety of exercise modes. The disclosed exercise apparatus leads a primary exercise track of backward and downward sliding. The variety of exercise modes of the stepper includes a simultaneous stepping mode, an alternate stepping mode, an undulate stepping mode, and a floating stepping mode. Besides, the stepper exercise apparatus integrates an expanding exercise track into the primary exercise track so that the exercise track of the pedals can horizontally expand outward with enlarged swing amplitude.

The foregoing undulate stepping mode and floating stepping mode are distinguished from each other by the swing amplitude of the vertical movement thereof. The undulate stepping presents swing amplitude of the vertical movement larger than that of the floating stepping. Thus, a user performing the floating stepping exercise shows a body heave less significantly than that of the undulate stepping, and such exercise gives a bystander an image as if the user is floating.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
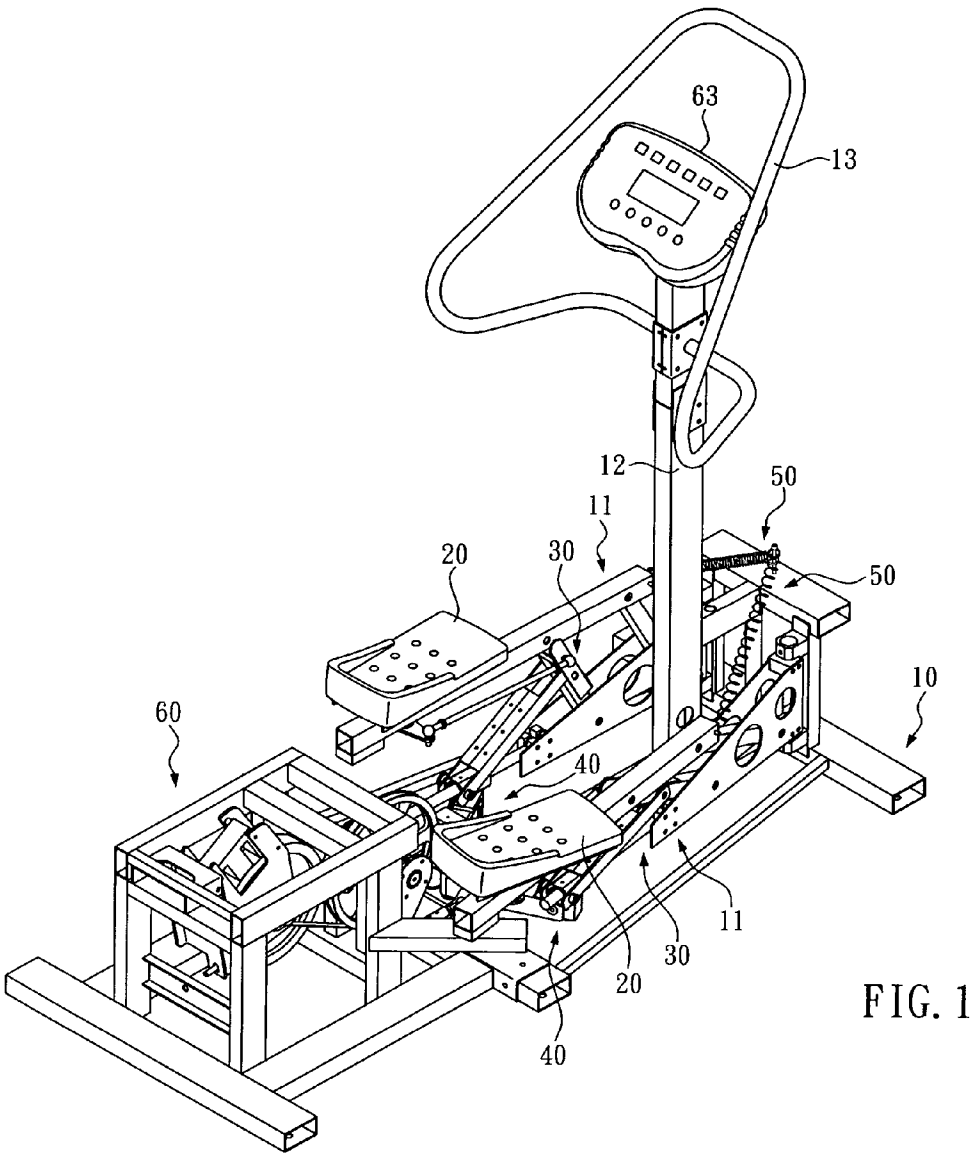
FIG. 1 is a perspective view of a hip-abduction stepper exercise apparatus according to the present invention.
Figure 2:
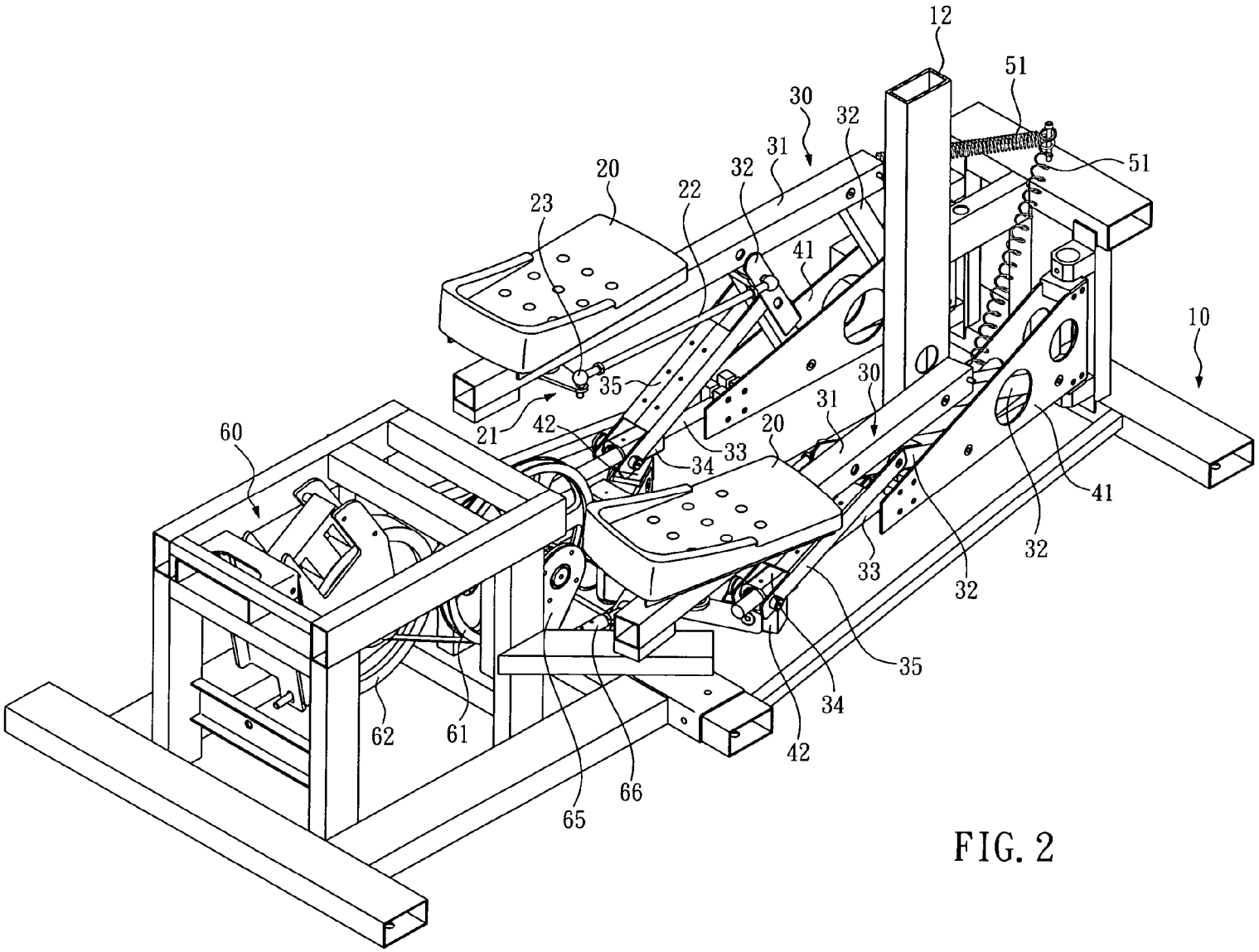
FIG. 2 is an oblique rear elevation of the pedal assemblies of the hip-abduction stepper exercise apparatus according to the present invention.
Figure 3:
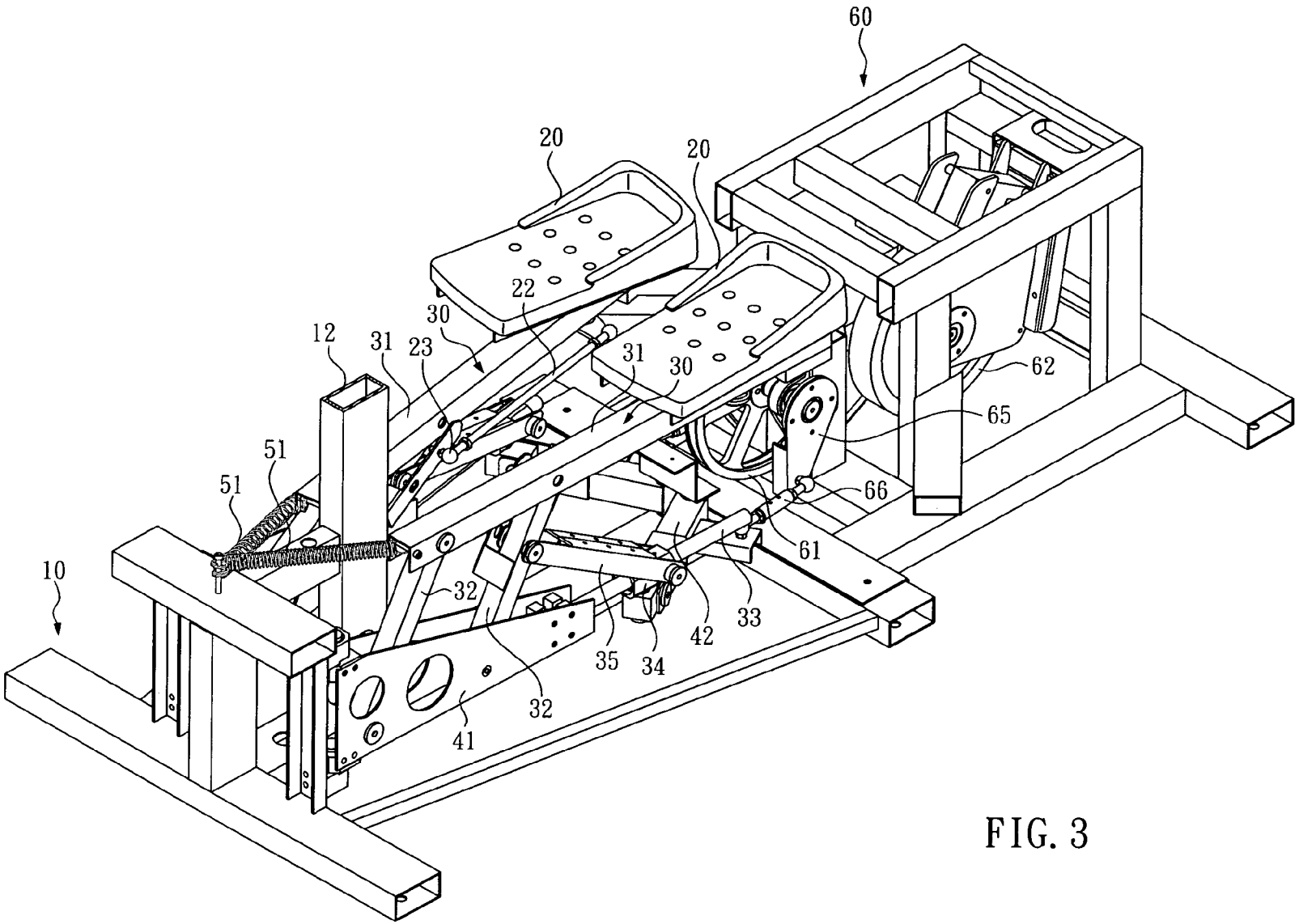
FIG. 3 is an oblique front elevation of the pedal assemblies of the hip-abduction stepper exercise apparatus according to the present invention.
Figure 4:
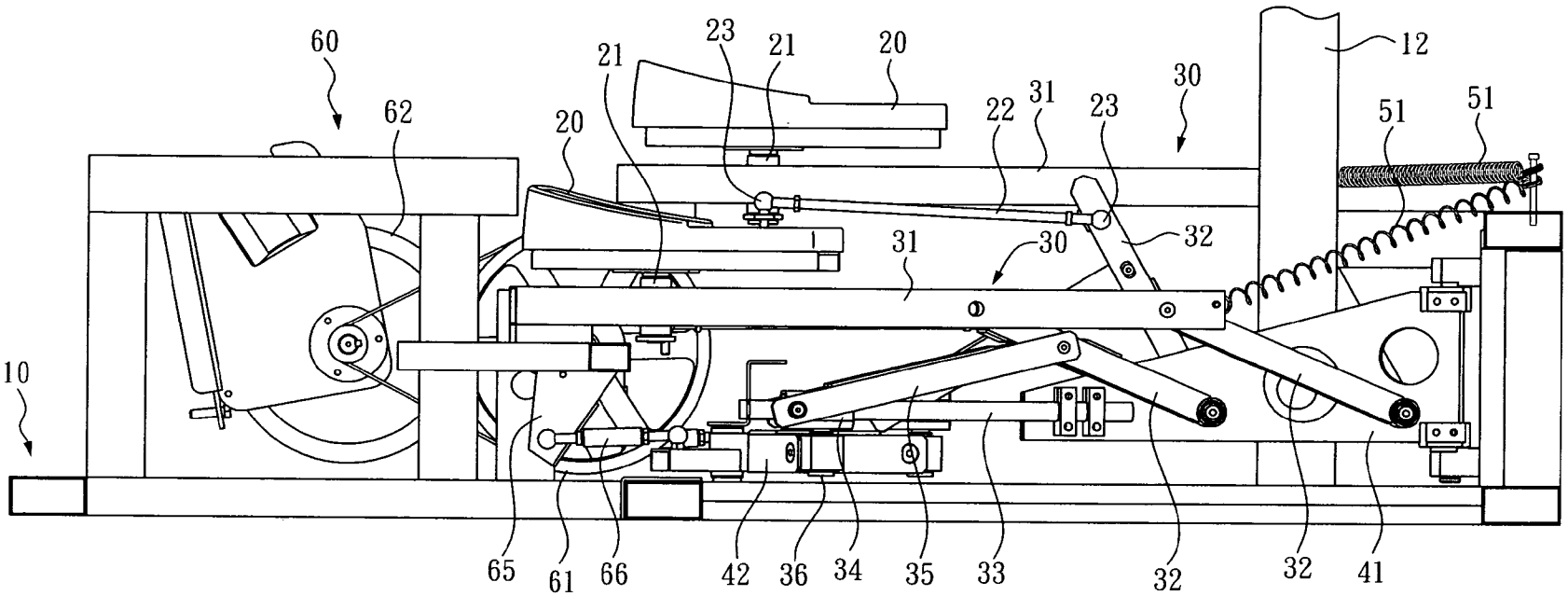
FIG. 4 is a lateral view of the pedal assemblies according to the present invention.
Figure 5:
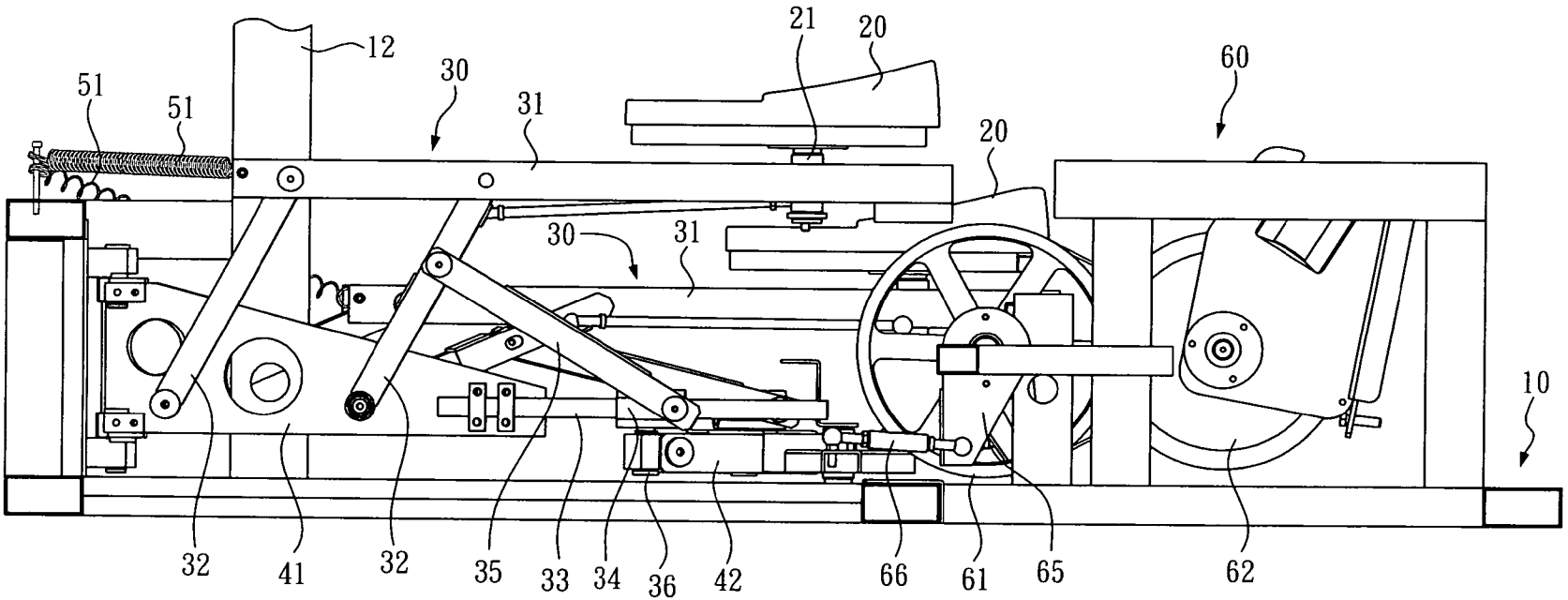
FIG. 5 is another lateral view of the pedal assemblies according to the present invention.

Referring to FIGS. 1 through 3, the disclosed hip-abduction stepper exercise apparatus primarily comprises a base 10 and two unconnected pedal assemblies 11 settled abreast on the base 10.

Each said pedal assembly 11 includes a pedal 20, a vertical movement module 30, an expanding movement module 40 and a recovery module 50. The expanding movement module 40 is settled on the base 10 and can swing horizontally over the base 10 for a predetermined angle. The vertical movement module 30 is connected to the expanding movement module 40. The pedal 20 is connected to the vertical movement module 30. The recovery module 50 is connected to the vertical movement module 30 and the base 10 for providing an external force in order to return the vertical movement module 30 to an initial altitude thereof and to return the expanding movement module 40 to an initial position thereof.

When a user exerts a downward treading force to the pedal 20, the vertical movement module 30 guides the pedal 20 along a primary exercise track to slide downward and backward. Meanwhile, the expanding movement module 40 is driven by the vertical movement module 30 and leads the vertical movement module 30 and the pedal 20 to move along an expanding exercise track integrated into the primary exercise track. When the treading force from the user is inferior to the external recovering force from the recovery module 50, the vertical movement module 30 and the expanding movement module 40 can be driven to return to the initial altitude and position thereof as described above by the recovery module 50.

Figure 7:
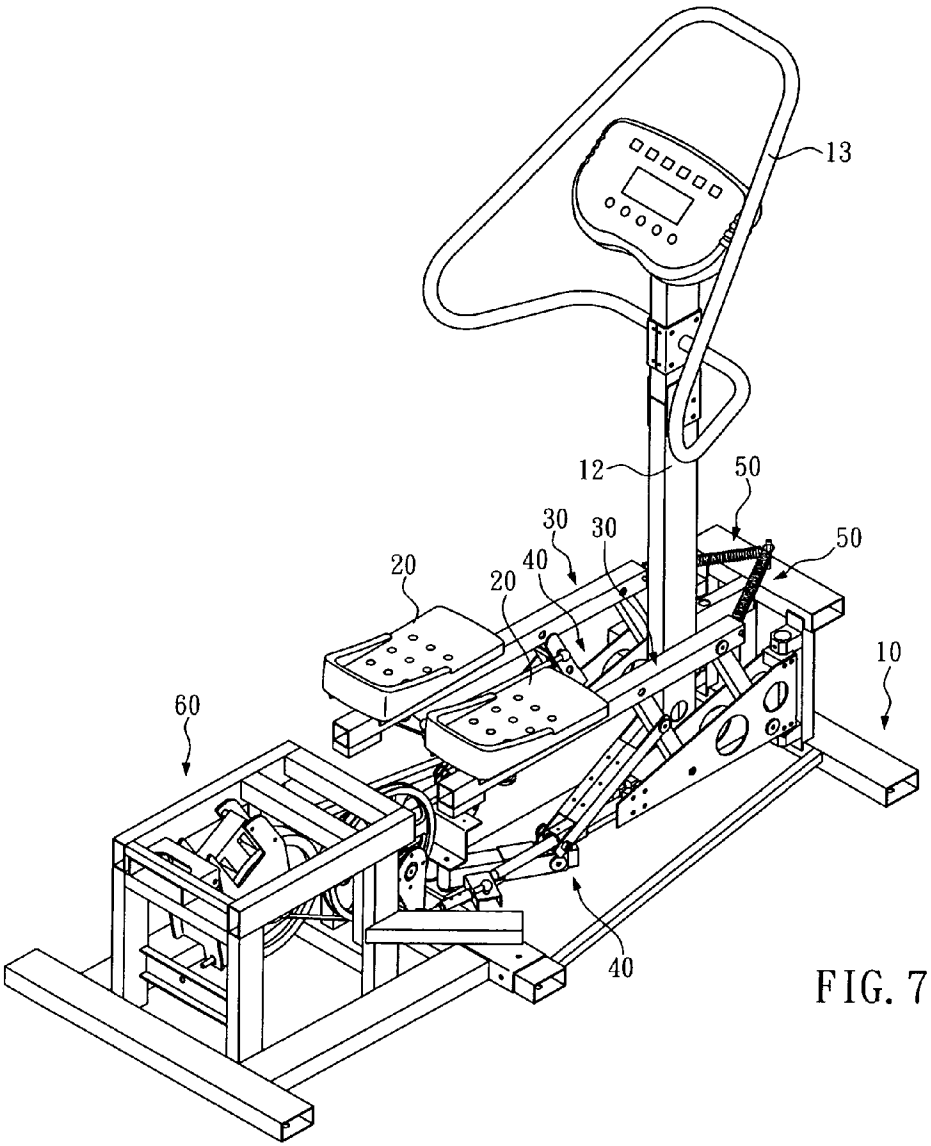
FIG. 7 is an applied view showing the pedal assemblies in the simultaneous stepping mode.
Figure 8:
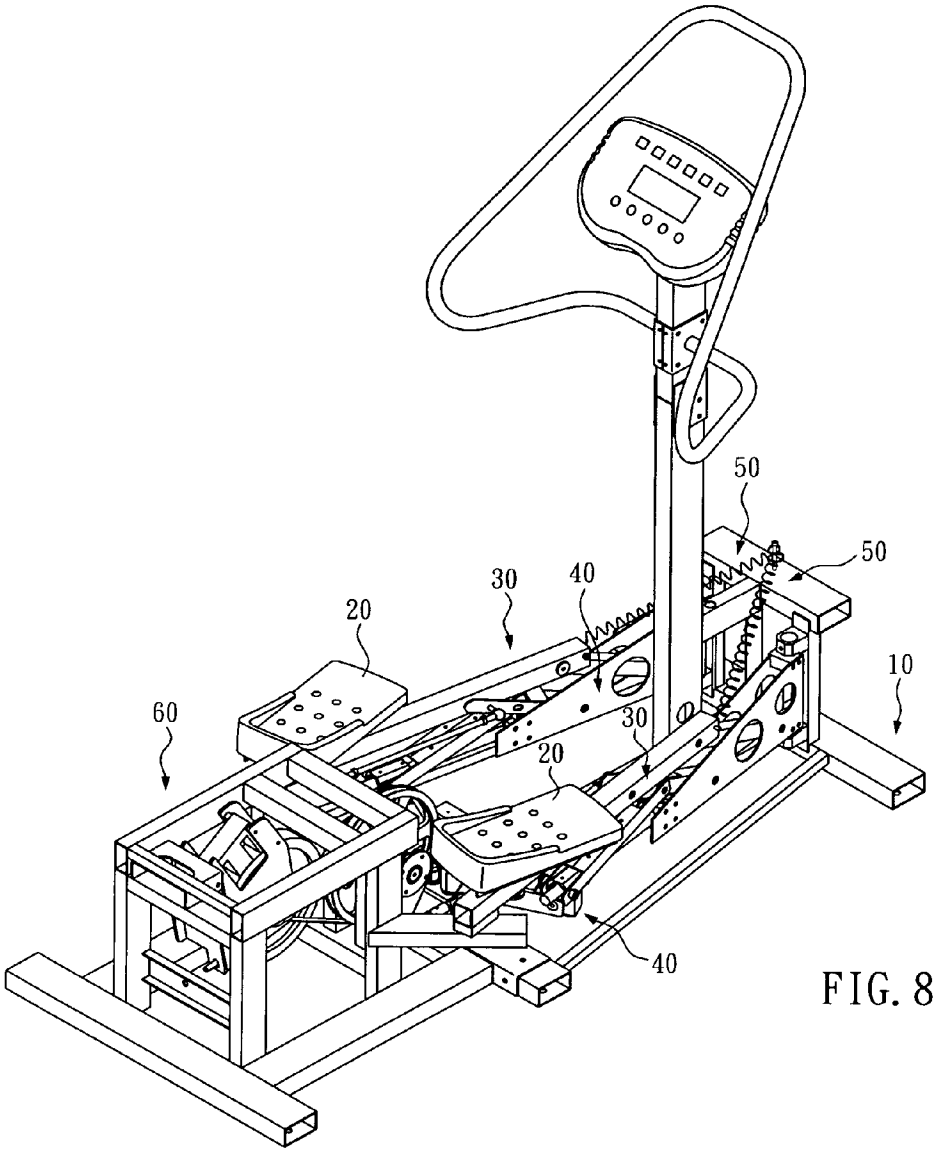
FIG. 8 is another applied view showing the pedal assemblies in the simultaneous stepping mode.
Figure 10:
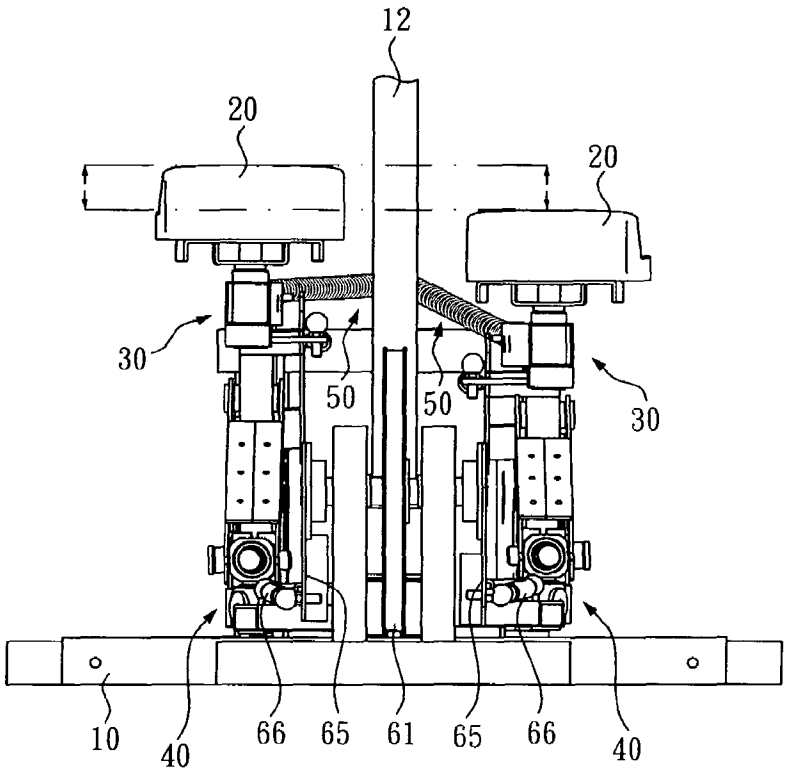
FIG. 10 is an applied view showing the pedal assemblies in the floating stepping mode.
Figure 9:
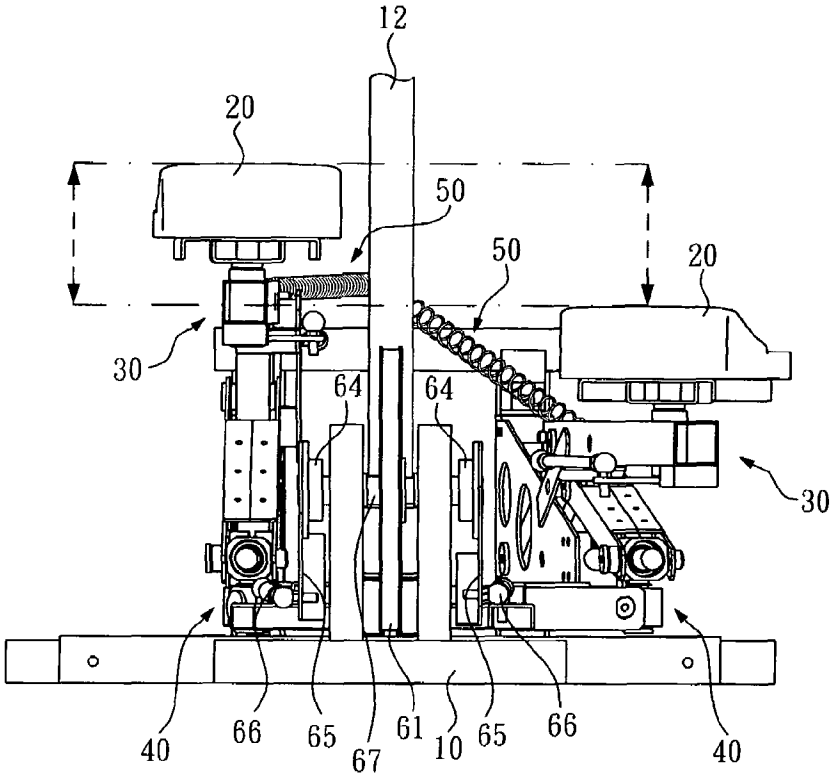
FIG. 9 is an applied view showing the pedal assemblies in the undulate stepping mode.

It is to be noted that the two pedal assemblies 11 are settled on the base 10 in a mutually independent manner so as to move independently of each other. Thereby, the disclosed stepper is capable of providing other stepping modes in addition to a normal reciprocal stepping mode. For example, a user may control both pedals 20 to move downward and upward abreast, as shown in FIGS. 7 and 8, in the condition that the user's body is given proper support. In that case, when the user treads down the pedals 20 with a heavy force and a gentle speed, the vertical movement module 30 leads the pedals 20 to conduct a full amplitude swing in the downward and upward directions. Consequently, the user's body shows significant heave and such stepping exercise is defined as the undulate stepping mode. In FIG. 9, the swing amplitude is depicted by the bidirectional arrows. On the contrary, when the user treads down the pedals 20 with a weak force and a sharp speed, the pedals 20 conduct a partial amplitude swing in the downward and upward directions. Consequently, the user's body shows slight heave and such stepping exercise is defined as the floating stepping mode. In FIG. 10, the swing amplitude is depicted by the bidirectional arrows. It is obvious that the swing amplitude in FIG. 9 is more significant than that in FIG. 10.

One preferred embodiment of the present invention described below in conjunction with the accompanying drawings is provided to explain the aforementioned main components of the present invention.

As shown in FIGS. 1 through 6, the expanding movement module 40 comprises a swing seat 41 and a swing rod 42. Both the swing seat 41 and the swing rod 42 have one end thereof rotatably connected to the base 10. Particularly, it can be seen in FIG. 6 that the swing seat 41 has the end connected to the base 10 through a pivot 411 so that the swing seat 41 can swing on the pivot 411. The swing rod 42 is formed in an L-shape and has its middle portion connected to the base 10 through a pivot 421 so that the swing rod 42 can swing on the pivot 421.

Briefly, the vertical movement module 30 can be embodied with a linkage system. There may be numerous methods for materializing the vertical movement module 30, and one of them is illustrated by the drawings. The exemplificative vertical movement module 30 comprises a guide rod 31, two pushrods 32 and a linear orientation rod 33. The pedal 20 is settled on the guide rod 31. The two pushrods 32 are movably connected to the guide rod 31 and the swing seat 41. The linear orientation rod 33 has one end thereof fixedly connected to the swing seat 41 and a sliding component 34 is slidably settled thereon. A sliding rod 35 is movably connected with the pushrods 32 and the sliding component 34. The sliding component 34 is further connected to a swing end of the swing rod 42 via the pivot 36. The recovery module 50 is an elastic component 51 with one end thereof fixed to the base 10 and the opposite end fixed to the end of the guide rod 31. Thereby, when the user treads down the pedal 20, the guide rod 31 generates a downward force to act on the pushrods 32. Then the pushrods 32 swing downward and the sliding component 34 is pulled by the sliding rod 35 to slide along the linear orientation rod 33 toward the rear of the base 10. As a result, the pedal 20 is led to slide downward and backward along the primary exercise track to draw and extend the elastic component 51. Meanwhile, the sliding component 34 drives the swing rod 42 to swing away from the axis of the base 10 so that the vertical movement module 30 and the swing seat 42 both swing outward and therefore the expanding exercise track is integrated into the primary exercise track of the pedal 20. When the treading force from the user is inferior to the resilience of the elastic component 51, the elastic component 51 resiles and pulls the guide rod 31 so that the vertical movement module 30 and the swing seat 42 move reversely to bring the pedal 20 to return the initial thereof.

In the present embodiment, since the pedal 20 is connected to the guide rod 31 by means of a shaft 21, the pedal 20 is rotatable over the guide rod 31. The shaft 21 and the pushrods 32 are connected through a linear rod 22 and universal joints 23 are implemented at the junctions. Thereby, the pedal 20 can be turned horizontally outward for a predetermined angle while it moves along the primary exercise track.

Figure 6:
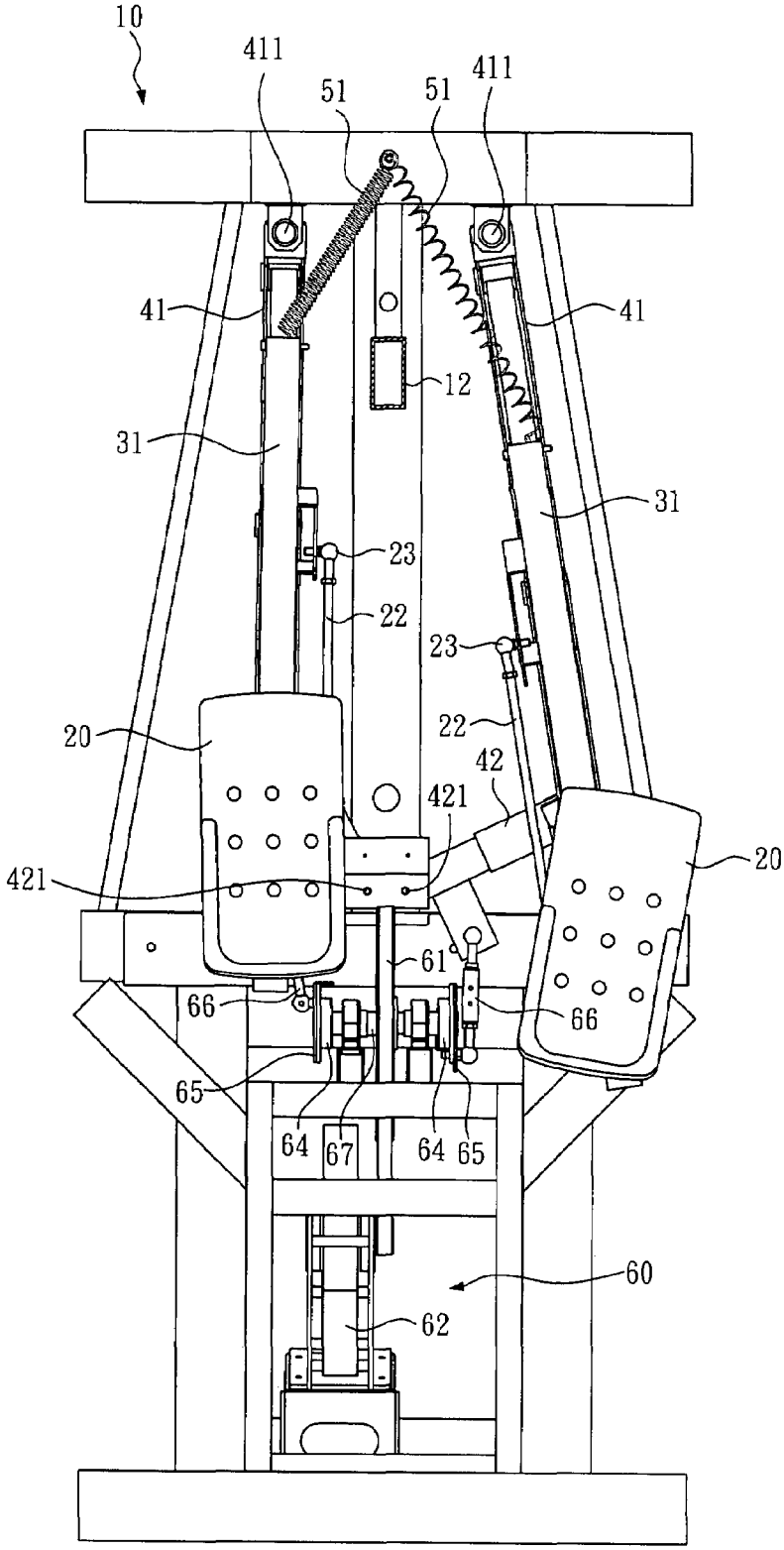
FIG. 6 is a top view of the pedal assemblies according to the present invention.

As in FIGS. 1 and 6, the disclosed hip-abduction stepper exercise apparatus further comprises a damping device 60. The damping device 60 comprises a damping wheel 61 rotatably settled on the base 10 through an axle 67, a damper 62 for providing a rotational resistance to the damping wheel 61, and a controller 63 fixedly settled on the top of a central stem 12 and electrically connected with the damper 62 for controlling the rotational resistance. Each end of the axle 67 of the damping wheel 61 is connected to one end of a crank 65 by means of a one-way bush 64 while the opposite end of the crank 65 is connected to the swing rod 42 by means of a link 66. The one-way bush 64 contributes to a specific relation between the crank 65 and the axle 67 of the damping wheel 61 as below. When the crank 65 swings toward the rear of the base 10, it drives the axle 67 and the damping wheel 61 to rotate. When the crank 65 swings back toward the front of the base 10, it runs idly. Hence, when the pedal 20, the vertical movement module 30 and the expanding movement module 40 cooperatively implement the primary exercise track and the expanding exercise track, the crank 65 is pulled to swing toward the rear of the base 10 and in turn drives the axle 67 and the damping wheel 61 to rotate so that a resistance to motion can be generated in company with the operation of the primary exercise track and the expanding exercise track. On the contrary, when the recovery module 50 brings the pedal 20, the vertical movement module 30 and the expanding movement module 40 to return, the crank 65 is pulled to swing toward the front of the base 10. At this time, the idle running between the crank 65 and the axle 67 ensures the said return free from resistance.

Referring to FIG. 1 again, a handrail 13 may be provided on the central stem 12 of the disclosed stepper exercise apparatus for giving support to the user during his taking exercise.

Although a particular embodiment of the invention has been described in detail for purposes of illustration, it will be understood by one of ordinary skill in the art that numerous variations will be possible to the disclosed embodiments without going outside the scope of the invention as disclosed in the claims. The main idea of the present invention is to provide a stepper exercise apparatus that provides the integrated expanding exercise track. While the two unconnected pedal assemblies are described above as preferred embodiment for realizing the expanding exercise track, a conventional associated pedal assembly may be also implemented in the present invention.

What the invention claimed is:

1. A hip-abduction stepper exercise apparatus primarily comprising a base and two pedal assemblies settled abreast on the base, wherein each said pedal assembly comprises: an expanding movement module and a recovery module having a swing seat and a swing rod, wherein both the swing seat and the swing rod have one end thereof rotatably connected to the base; a vertical movement module, having a guide rod, at least one pushrod, and an orientation rod, wherein the pushrod is movably connected to the guide rod and the swing seat; the orientation rod is fixedly connected to the swing seat; and a sliding component slidably settled on the orientation rod is further connected to a swing end of the swing rod by means of a pivot; a pedal settled on the guide rod; and an elastic component with one end thereof fixed directly to the base and the opposite end fixed directly to an end of the guide rod.

2. The hip-abduction stepper exercise apparatus of claim 1, wherein, the pedal is connected to the guide rod by means of a shaft, and the shaft is connected to the pushrod by means of a linear rod.

3. The hip-abduction stepper exercise apparatus of claim 1 further comprising a damping device, which has a damping wheel rotatably settled on the base with an axle and a damper for providing a controllable resistance to the damping wheel wherein each end of the axle of the damping wheel is connected to one end of a crank by means of a one-way bush while the opposite end of the crank is connected to the swing rod by means of a link.

4. The hip-abduction stepper exercise apparatus of claim 3, wherein, the resistance provided by the damper is set through a controller electrically connected with the damper.

5. The hip-abduction stepper exercise apparatus of claim 4, wherein, the controller is fixedly settled on the top of a central stem that is settled on the base.

6. The hip-abduction stepper exercise apparatus of claim 5, wherein, a handrail is provided on the central stem.

* * * * *